US005143478A

United States Patent [19]

Bowman

[11] Patent Number: 5,143,478

[45] Date of Patent: Sep. 1, 1992

[54] ADJUSTABLE MANHOLE COVER SUPPORT WITH SPANNERS

[76] Inventor: Harold M. Bowman, 18867 N. Valley Dr., Fairview Park, Ohio 44126

[21] Appl. No.: 670,710

[22] Filed: Mar. 18, 1991

Related U.S. Application Data

[63] Continuation-in-part of Ser. No. 536,691, Jun. 12, 1990, abandoned, which is a continuation-in-part of Ser. No. 362,257, Jun. 6, 1989, Pat. No. 4,963,053, Ser. No. 362,216, Jun. 6, 1989, Pat. No. 4,966,489, Ser. No. 366,177, Jun. 13, 1989, Pat. No. 4,969,771, Ser. No. 473,324, Feb. 2, 1990, and Ser. No. 362,277, Jun. 6, 1989, Pat. No. 4,969,770, which is a continuation-in-part of Ser. No. 323,622, Mar. 14, 1989, abandoned, Ser. No. 207,325, Jun. 15, 1988, abandoned, Ser. No. 207,326, Jun. 15, 1988, abandoned, Ser. No. 76,668, Jul. 23, 1987, Pat. No. 4,834,574, Ser. No. 201,573, Jun. 1, 1988, Pat. No. 4,867,600, Ser. No. 207,266, Jun. 15, 1988, Pat. No. 4,867,601, and Ser. No. 207,185, Jun. 15, 1988, Pat. No. 4,872,780.

[51] Int. Cl.[5] ..... E02D 29/14

[52] U.S. Cl. ..... 404/26

[58] Field of Search ..... 404/26, 25; 52/20

[56] References Cited

U.S. PATENT DOCUMENTS

| | | | |
|---|---|---|---|
| 3,392,640 | 7/1968 | Zeile, Jr. | 404/26 |
| 4,867,600 | 9/1989 | Bowman | 404/26 |
| 4,927,290 | 5/1990 | Bowman | 404/26 |

*Primary Examiner*—Ramon S. Britts

*Assistant Examiner*—Nancy P. Connolly

*Attorney, Agent, or Firm*—Watts, Hoffmann, Fisher & Heinke Co.

[57] ABSTRACT

An adjustable manhole cover support, useful in repaving or resurfacing of road for raising the grade of an existing structure like a manhole frame, that holds a circular cover and is capable of fitting frame openings of somewhat varying diameters, is shown. With this cover support one can standardize on a specific, single diameter manhole cover size for a group of manholes that otherwise would call for an inventory of several different cover sizes. The new cover support comprises a base ring for fitting inside the existing receiving structure, the base ring having at least one adjustable joint with a means for changing the base ring periphery, a lateral cover keeper ring that rises from about the level of the top of the base ring and extends above and preferably is substantially concentric with and substantially larger in diameter than the base ring, a plurality of spanners which bridge the distance between thr rings, at least a pair of the spanners connecting the inner ring with the outer ring, the spanners an/or the keeper ring being self-repositionable in the cover support in response to and accommodation of an adjustment in the periphery of the base ring. The inclination of the surface that is to surround the emplaced cover support can be at least partially compensated for by the spanners' upper surfaces being disposed for establishing a stable inclined plane across them on which to rest a manhole cover.

37 Claims, 7 Drawing Sheets

ADJUSTABLE MANHOLE COVER SUPPORT WITH SPANNERS

REFERENCE TO OTHER APPLICATIONS

This patent application is a continuation-in-part of Applicant's U.S. patent application, Ser. No. 07/536,691, filed Jun. 12, 1990, having the same title as this one and now abandoned. Application Ser. No. 07/536,691 was the continuation-in-part of Applicant's following U.S. patent applications: Ser. No. 07/362,277, filed Jun. 6, 1989, entitled *Manhole Cover Support With Topside Flange,* now U.S. Pat. No. 4,969,770; Ser. No. 07,362,257, filed Jun. 6, 1989, entitled *Multicomponent Wales and Bases for Manhole Cover Supports,* now U.S. Pat. No. 4,963,953; Ser. No. 07/362,216, filed Jun. 6, 1989, entitled *Manhole Cover Support with Interbraced Top,* now U.S. Pat. No. 4,966,489; Ser. No. 07/366,177, filed Jun. 13, 1989, entitled Manhole Cover Support Having Enhanced Grip, now U.S. Pat. No. 4,969,771; and Ser. No. 07/473,324, filed Feb. 2, 1990, having the same title as Ser. No. 07/366,177.

Application Ser. No. 07/362,277 was a continuation-in-part of Applicant's now-abandoned U.S. applications: Ser. No. 07/323,622, filed Mar. 14, 1989, entitled *Support for a Manhole Cover of Standardized Diameter;* Ser. No. 07/207,325, filed Jun. 15, 1988, entitled *Manhole Cover Support Resistant to Water Infiltration;* Ser. No. 07/207,326, filed Jun. 15, 1988, entitled *Manhole Cover Support Having Enhanced Grip.* It also was a continuation-in-part of applications Ser. No. 07/076,668 filed Jul. 23, 1987; 07/201,573 filed Jun. 1, 1988; 07/207,266 resulting U.S. Pat. Nos. 4,834,574; 4,867,600; 4,867,601; and 4,872,780 respectively.

BACKGROUND OF THE INVENTION

This invention relates to round manhole cover supports for emplacing over and raising the grade of an existing manhole cover-receiving structure, more particularly to such supports that are adjustable to fit access holes, and especially to such supports that can accomodate a group of circular manhole covers of a standard size and shape where the frames or other existing cover-receiving structures thereunder diverge somewhat as to the diameter of the covers that can fit them.

For simplicity the term "existing manhole cover-receiving structure" is used here to refer to the existing, i.e., fixed in-place frame or other seating receptacle for a removable cover or grating that covers an access hole (i.e., hand hole, tool hole, manhole, catch basin or the like). The term "manhole cover" is used in this application to refer to a round removable cover or grating over the access hole. The resulting assembly of a receiving structure and a manhole cover ordinarily is intended to bear vehicular traffic. The term "manhole cover support" or simply "cover support" here means a structure that fits over the existing manhole cover receiving structure, raises its grade, and thereby accommodates a cover or grating at the new elevated grade. The access hole covered usually is a utility enclosure serving, e.g., an electric, gas, water, sewer or storm drainage system.

The preponderance of manholes are circular (in street plan), have circular covers and have existing cover-receiving structures such as frames that have circular access holes, circular sills to support the cover, and circular lateral cover keepers (the latter also sometimes termed "collars"). Accordingly, this specification is directed to round manhole cover supports that have ring-like annular elements which are to interact with an existing round manhole cover-receiving structure.

Ordinarily a cover support finds its use when a roadway such as a street or highway is resurfaced with an added layer of paving material, typically asphalt concrete or sheet asphalt, to establish a higher grade. A principal use for the instant cover support is expected to be in a municipality where a group of manhole installations of somewhat varying diameters are likely to be encountered in the resurfacing. Thus, adjoining or the same subdivisions, boroughs, wards or districts may have existing manhole cover frames for accommodating a group of covers that are nominally of several fairly close sizes, say, about 23 or 24 inches in diameter. When resurfacing in such an area, it may be decided to standardize on a single diameter, 24- or 25-inch, cover for this group to reduce the inventory of covers, purchase covers in larger lots, avoid having to use or to buy potentially costly custom-built equipment or require short manufacturing runs, and certainly to eliminate the digging out, raising and resetting of the existing frames or other cover-receiving structures simply to accommodate their original variously-sized manhole covers. It then can be especially advantageous to mount the inventive cover supports atop these existing manhole cover frames for the standardization purpose.

Heretofore the typical installation of new manhole cover supports has seemingly been circumscribed by and restricted to the reuse of the old cover. The possible benefits of standardizing on a new, larger cover diameter in place of a group of covers that include ones which vary a little in diameter from one to another or from one subgroup to another, then designing a new cover support expressly for the new standardized covers appears to have gone unrecognized; it does not seem to have been addressed at all by the art other than my prior applications Ser. Nos. 07/323,622 ; and 07/362,277 referred to above.

Axle loads up to 18,182 kg. must be resisted by many of these cover supports as well as serious impact loads from vehicles and snow plows plus a variety of temperature effects, steam leaks, spillage, etc., without permitting a hazardous dislocation of the cover support or its cover. Often it is desirable also to cushion the cover for resisting wear or Reducing noise, and/or to seal the cover and its cover support against a substantial and possibly overloading infiltration of surface water. e.g., storm drainage that otherwise would enter a sanitary sewer system at various manhole locations.

The instant cover support can be made especially highly resistant to displacement and dislodgement in service, i.e., stable. Preferably it incorporates structural or mechanical holddown (anchoring) means to the existing manhole cover-receiving structure, e.g., strong hook-like extensions that are integral with it or are easily attached. Also, it can be constructed to maintain a strong frictional grip in the existing manhole cover-receiving structure. Its unique structure fills a place in street maintenance that has heretofore been neglected.

BROAD STATEMENT OF THE INVENTION

In its broadest sense the instant manhole cover support is for raising the grade of an existing manhole cover-receiving structure that has a lateral keeper. It comprises:

a base ring for fitting inside the existing manhole cover-receiving structure, said base ring having nominal outside diameter of $D_1$ and at least one adjustable joint for adjustment of the base ring periphery;

a lateral cover keeper ring rising from a level near the top of the base ring and extending above and around it, said keeper ring having nominal inside diameter of $D_2$ which is substantially larger than said diameter $D_1$ and has an outer periphery that is at least substantially coextensive with the top outer periphery of the existing manhole cover-receiving structure;

means for making an adjustment in the periphery of the base ring, and a plurality of spanners which bridge the distance between the rings, the inner terminal of each spanner making contact with the base ring at or near its top, the outer terminal of each spanner making contact with the keeper ring at or near its bottom, at least a pair of the spanners being connecting spanners having their inner terminals connected to the base ring and their outer terminals connected to the keeper ring to constitute a linkage between said rings, the spanners and/or the keeper ring being disposed to reposition themselves in the cover support structure in response to and in accommodation of an adjustment in the periphery of the base ring.

The outer periphery of the keeper ring best is larger than and certainly it should be at least practically coextensive when adjusted to its smallest size, if the keeper ring is adjustable, with the outer periphery of the top of the largest of the existing manhole cover-receiving structures of a group whose grade is to be raised by the same kind and size of support. Thus, it will cover any existing cover-receiving structure of the group. The outer periphery of the new cover support, of course, can extend even further outward any case, its keeper bottom extending beyond the outside of its keeper wall, if desired. It usually is desirable for such outer wall to spring from the edge of the base, with the base being larger around than the top rim of the largest of the existing manhole cover-receiving structures of the group being raised. This usually is desirable, as a built-in factor of support safety.

The new cover support preferably rests on and is supported by the upper rim of the collar of the existing cover-receiving structure as well as the seat therein in which a manhole cover once lay. However, its being supported by just said upper rim or just said former seat usually can be quite adequate.

Confining the cover laterally in the new cover support is the lateral keeper. It usually rises as the outer periphery of the new cover support, although it can be inboard from that if desired. The keeper often desirably is topped with an outwardly- and downwardly-projecting box member (i.e., hollow) or slid member substantially larger in overall width and in overall depth than the thickness of the wall of the keeper; herein it will be referred as a "wale", and its adds much resistance to deformation of the keeper rim from various directions.

BEST MODES FOR CARRYING OUT THE INVENTION

Figure 1:
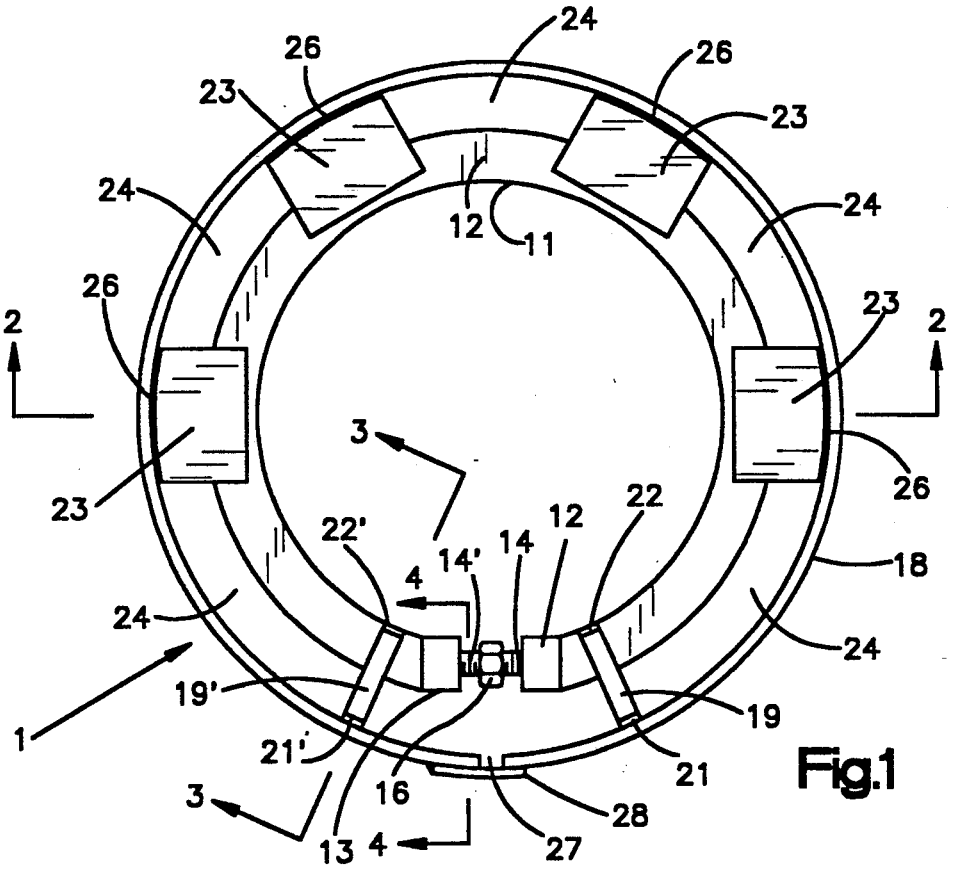
FIG. 1 is a top plan view of a preferred form of the apparatus having an interrupted lateral keeper ring.

Reference is made to FIGS. 1 through 4. Arrow 1 indicates generally a cover support with a 12 ga. steel split ring as the lateral keeper ring 18 and a solid cast malleable iron base ring 11 having a single stainless steel turnbuckle joint. It is for adjusting the perimeter of the split base ring 11. The base ring 11 terminates in a pair of opposed round sockets 12 and 13. These are threaded internally to receive the opposed threads 14'0 and 14 on the bolts extending to the right and left of wrench grip 16. The threaded sockets 12 and 13, and the threaded bolts 14 and 14' with their wrench grip 16 constitute this turnbuckle joint.

Two stiff flat steel bars 19 and 19' (in this instance the connecting spanners) extend from the base ring 11 to the keeper ring 18. Welds 21 and 21' fixedly attached them to the keeper ring and welds 22 and 22' fixedly attach them to the base ring 11. Four horizontal steel plates 23 are welded by the welds 26 to the inside of the keeper ring 18. The plates extend out to rest on and slide on the flat top 12 of base ring 11. These plates 23 are the sliding spanners. The bars 19 and 19' and these sliding spanners 23 act as seating for the new manhole cover (not shown).

Expansion or contraction of the base ring periphery forces the base ring 11 to get larger or smaller, this concomitantly forcing a correspondingly larger or smaller vertical gap 27 in the periphery of the keeper ring 18 by means of the bars 19 and 19'. Cover 28, welded to the left side of the gap 27 and sliding over the wall of keeper ring 18 to the right of the gap 27, covers the gap to protect it against intrusion of fluent asphalt.

The flat tops of bars 19 and 19' and of the sliding spanners 23 act as the seat for the new manhole cover (not shown) that is to fit into the cover support 1. There are open spaces 24 between the vertical projection of the inner (base) and outer (keeper) rings. A short lip not shown, preferably interrupted repeatedly to keep from imparting a great deal of extra resistance to expansion and contraction of the periphery of keeper ring 18, can project from the inner side of the keeper ring 18 and a ways out over the spaces 24 to act also as more seating for the new cover. If desired, a third bar (not shown) like bars 19 and 19' can be used to connect the rings diametrically opposite the gap 27 in the keeper ring 18.

Figure 2:
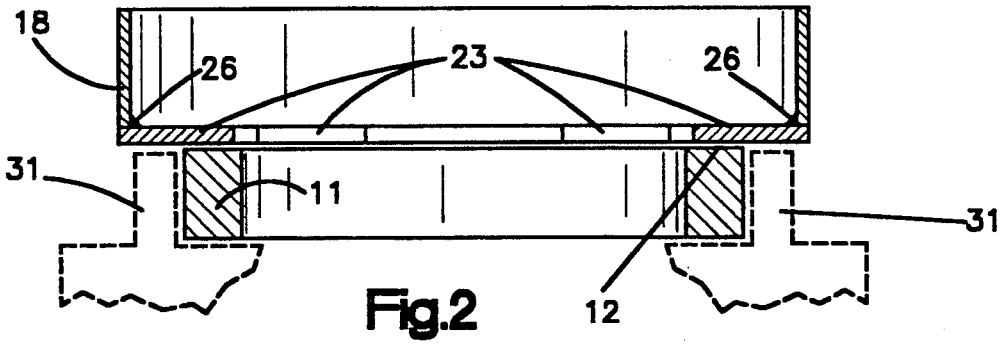
FIG. 2 is a cross sectional elevation of the apparatus of FIG. 1 taken through Section 2—2 thereof.

In FIG. 2 the existing manhole cover-receiving structure 31, a frame, is shown in dashed lines. Inside its collar and resting on the sill of the frame 31, is the cast iron base ring 11 expanded tightly into place. In use the superstructure of the cover support that is, the steel (12 ga.) keeper ring and all of the steel spanners, connecting or sliding, rest on the top surface 12 of base ring 11 and the top rim of the collar of the existing cover-receiving structure frame 31. The views show welds 26 attaching the outer ends of the sliding spanners 23 to the bottom of the keeper ring 18. The inner ends corresponding simply slide across top 12 of base ring 11, although they could fit into slots or notches in the base ring if desired.

Figure 3:
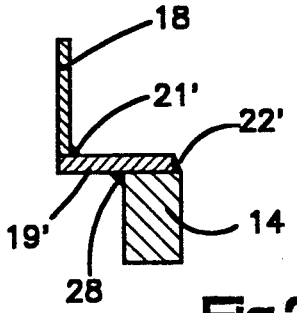
FIG. 3 is the cross section of the apparatus of FIG. 1 taken through the vertical plane indicated by Section 3—3 thereof.
Figure 4:
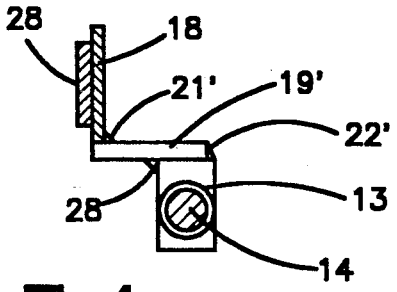
FIG. 4 is a cross-section of the apparatus of FIG. 1 taken through the vertical plane indicated by line 4—4 thereof.

In FIG. 3 the welds 22' and 28 are shown attaching stiff flat bar steel 19' to cast malleable iron base ring 14 and weld 21' attaching bar 19' to steel keeper ring 18. In FIG. 4 the welds 22 and 28 also are seen, as is weld 22', the side of bar 19, and the cross section of the threaded bolt 14 where it is screwed into socket 13 at the left side of the joint in base ring 11.

Figure 5:
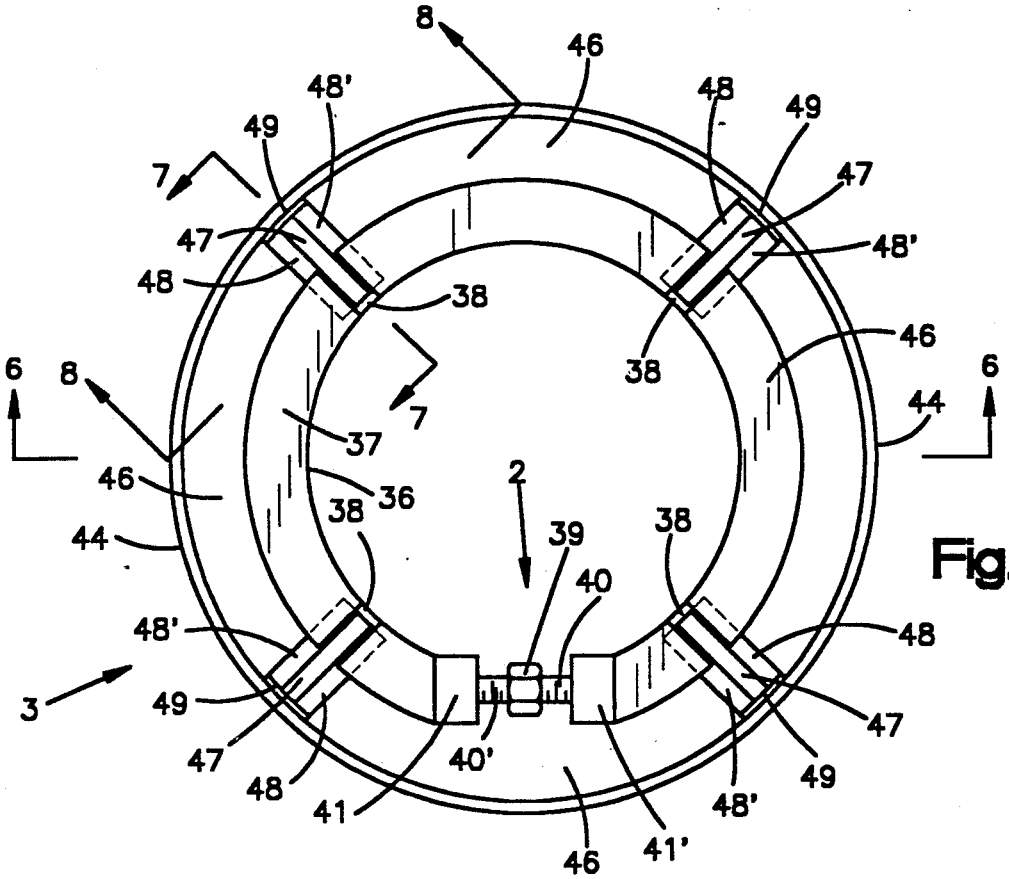
FIG. 5 is a top plan view of a preferred form of the apparatus wherein the spanners reach inward from a continuous (uninterrupted) keeper ring, and their inner terminal contacts can slide in and be held down by enveloping slots of the base ring.
Figure 6:
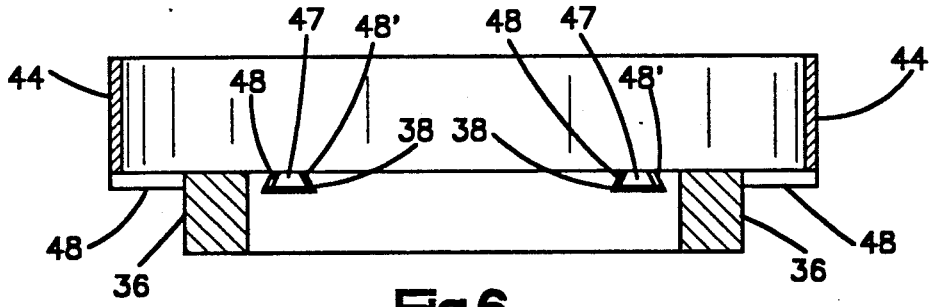
FIG. 6 is a cross sectional elevation of the apparatus of FIG. 5 taken through Section 6—6 thereof.
Figure 7:
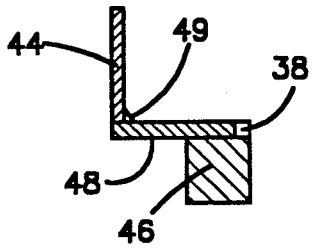
FIG. 7 is the cross section of the apparatus of FIG. 5 taken through the vertical plane indicated by Section 7—7 thereof.
Figure 8:
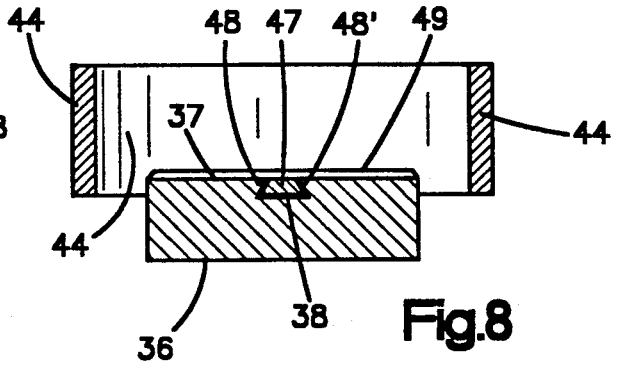
FIG. 8 is the cross section of the apparatus of FIG. 5 taken vertically through Section 8—8 thereof.

Reference is now made to FIGS. 5 through 8. Arrow 3 indicates generally a manhole cover support wherein the steel keeper ring 44 is of fixed periphery. The flat top surface 37 of solid steel base ring 36 is slotted with four slots 38 having a base-down trapezoidal cross section. From the inside wall of the keeper 44 a corresponding steel spanner 47 projects into each slot 38. The spanners, too, are of base-down trapezoidal cross section with side walls 48 and 48'. Each of these spanners 47 can slide essentially radially inside its corresponding slot 38. The slot prevents the spanner from lifting out upwardly but permits radial motion in and out of space 38 and a small amount of various sidewise motion of the spanner in the slot. The cross sectional FIGS. 6 and 8 show spanners in this slots. The clearances are exaggerated for ease of depiction but the trapezoidal sections need not have a very close fit to be effective.

Arrow 2 indicates generally the adjustable turnbuckle joint in the base ring 36. The turnbuckle joint is comprised of round threaded sockets 41 and 41' (at the gap in the base ring 36) into which screw opposed threaded bolt end 40 and 40' driven by rotation of wrench grip 39 to widen or narrow the gap. This adjusts the periphery of the base ring for tightening or loosening it in a manhole cover frame or like receptacle.

The spanners are bolted to the bottom of the keeper ring 44 by bolts not shown. After assembly with the base ring, the spanners can be fixed to the keeper ring even more strongly by welds 49.

Figure 9:
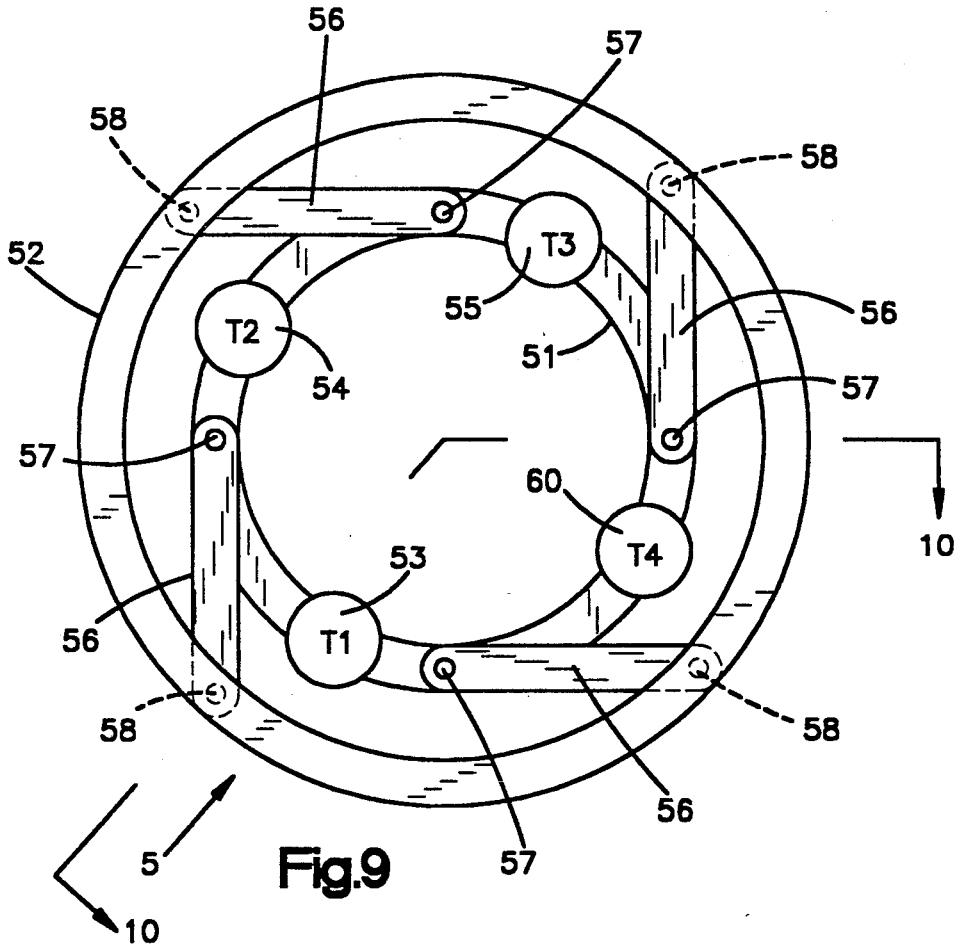
FIG. 9 is a partially diagrammatic top plan view of a preferred form of the apparatus with each of the spanners being connecting spanners that ar pivoted at both ends and the keeper ring being continuous.
Figure 10:
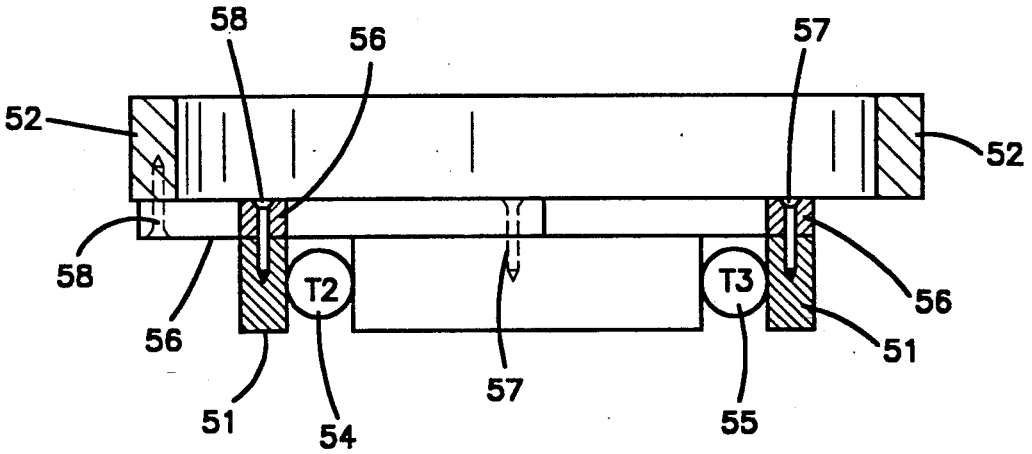
FIG. 10 is a cross sectional elevation of the apparatus of FIG. 9 taken through Section 10—13 thereof.
Figure 11:
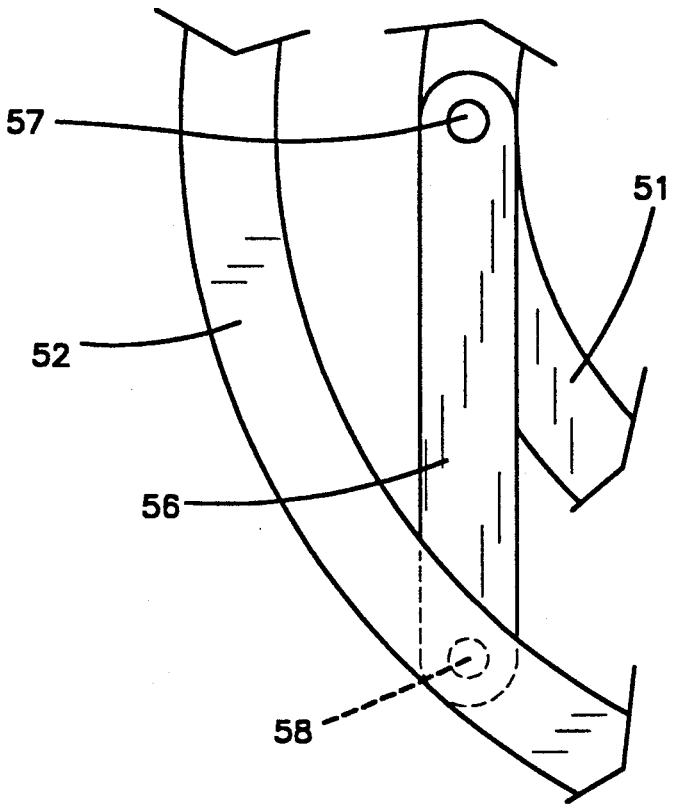
FIG. 11 is an enlarged view of a lower left side sector of FIG. 9 showing one of the four like spanners that are nominated items 56.

Referring to FIGS. 9, 10 and 11, arrow 5 indicates generally the cover support wherein the steel keeper ring 52 is continuous, the box member steel base ring 51 has four adjustable stainless steel joints indicted schematically as 53, 54, 55 and 60, and there are four bar-like steel spanners 56. As shown in FIG. 11, each spanner 56 is pivotally connected to base ring 51 by bolt 57 and pivotally connected to the keeper ring 52 by a bolt 58. The joints 53,54,55 and 60 are like the one operated by wrench grip 16 of FIG. 1. They are operated by turnbuckles to expand and contract the periphery of the inner (base) ring 51. The steel base ring is hollow and made of a pair of ring angular cross section shapes welded together.

Figure 12:
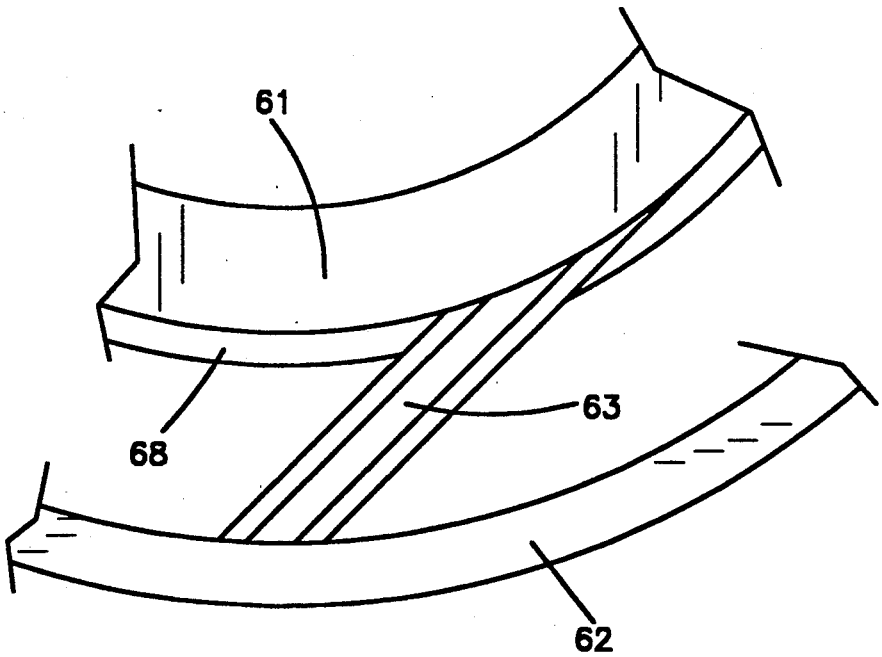
FIG. 12 is an enlarged view of a lower right sector of FIG. 13 showing one of the four flexible laminated metal spanners nominated items 63.
Figure 13:
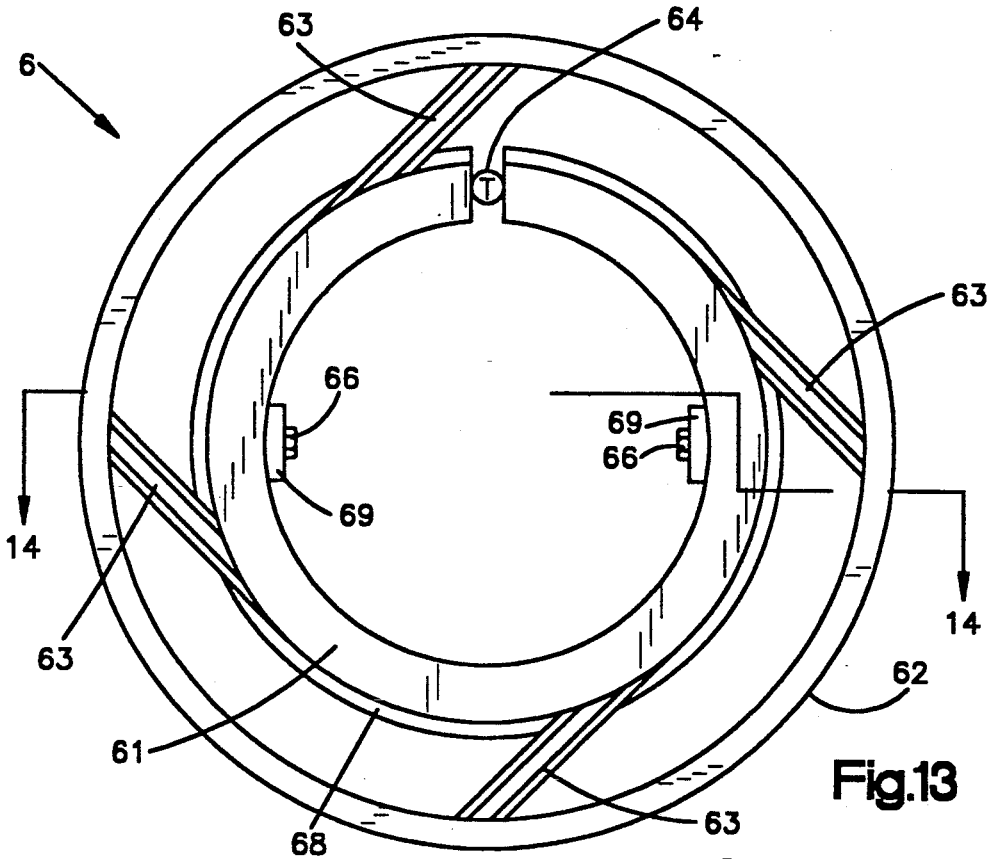
FIG. 13 is a partially diagrammatic top plan view of a preferred form of the apparatus with each of the spanners being flexible and the keeper ring continuous.

Turning to FIGS. 12 and 13, arrow 6 indicates generally a manhole cover support wherein the steel outer (keeper) ring 62 is continuous the inner (base) cast malleable iron ring 61 is split with an adjustable joint 64 (indicated schematically), and there are flexible laminated metal (steel) spanners 63. As shown in FIG. 12, one and of each spanner 63 is fixedly attached to the base ring 61 and the other end of the spanner is fixedly attached to outer (keeper) ring 62. Optionally, however, the inner and/or the outer ends of such spanners 63 can be slidably attached to the ring it reaches. Thus, an end can be riveted to a ring through a horizontal slot in the spanner. The object is to permit some deformation or displacement of the spanner in response to widening or narrowing the joint. Not all such spanners need to be connecting for the two rings. It is adequate to have just a pair or more connecting, the rest being attached to a ring by only one end.

Figure 14:
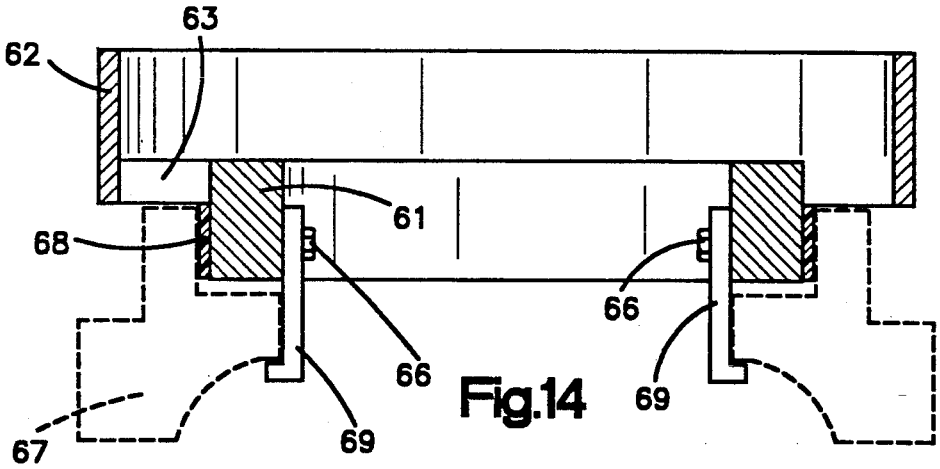
FIG. 14 is the cross sectional elevation of the apparatus of FIG. 13 taken through Section 14—14 thereof.

In FIG. 14 the cover support of FIG. 13 is shown as it fits into a manhole cover frame 67. On the outside of base ring 61 is a highly and adherent, about ⅛-inch thick, polymeric friction deposit 68. It is a baked-on, heat-cured, plasticized polyvinyl chloride plastisol coating, and it is somewhat elastomeric. When the base ring 61 is expanded to fit tightly into the frame 67, a very strong frictional force is developed to help hold the cover support in place. Hold-down (anchoring) clamps 69 hook below the sill of frame 67 and are attached to base ring 61 by means of threaded bolt 66. While only two such clamps are shown, more can be used if necessary or desired.

Figure 15:
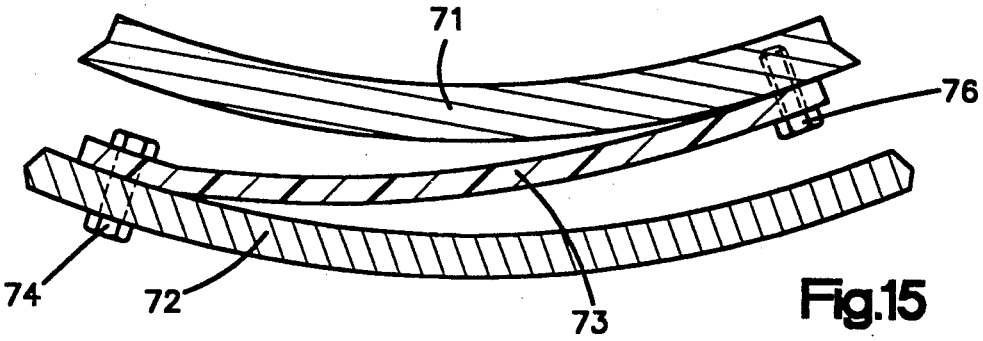
FIG. 15 is a fragmentary horizontal cross sections of apparatus similar to that of FIG. 13, but with fabric reenforced vulcanized rubber spanners.

FIG. 15 shows a fragment of a cover support wherein the base ring 71 is jointed to the keeper ring 72 by means of a fabric-reinforced vulcanized rubber spanner 73. The ends of the spanner are bolted to the keeper ring 72 by bolt 74 and to the base ring 71 by bolt 76. Otherwise this cover support is like that of FIGS. 13 and 14.

Figure 16:
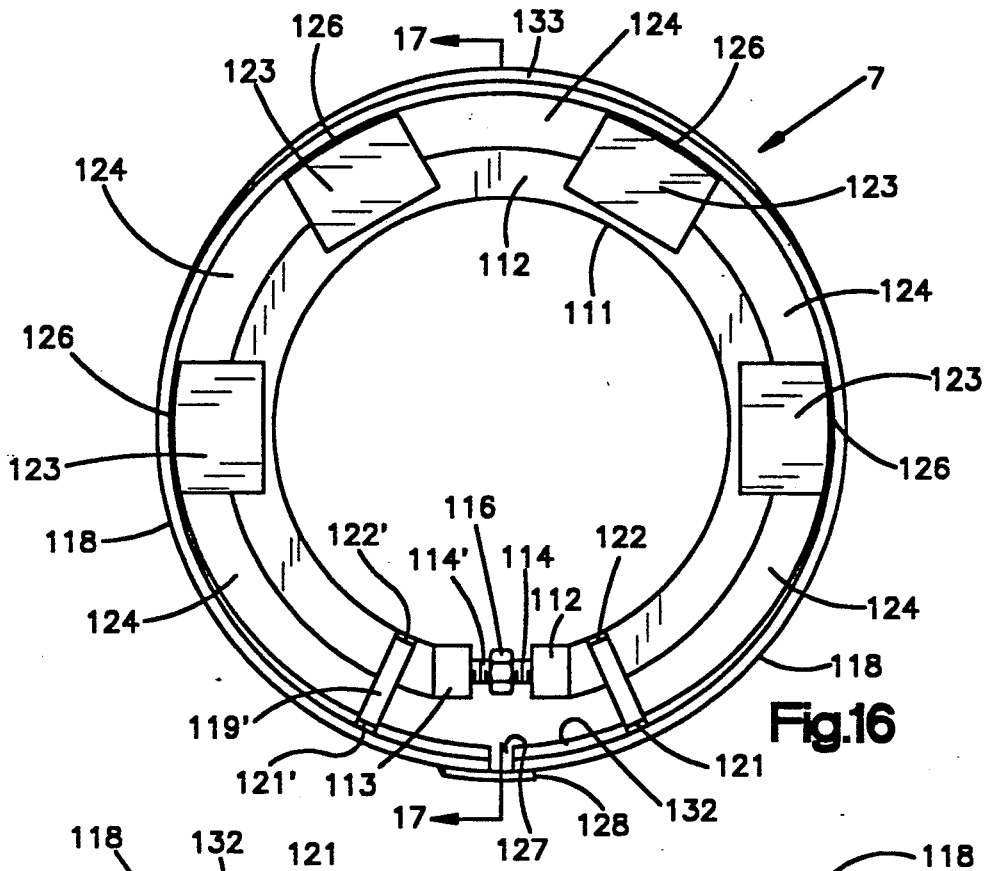
FIG. 16 is a plan view of a cover support made for compensating at least partially the inclination of the surface that is to surround the eventually emplaced cover, e.g, a street resurfaces to have high crown and a marked slope downward to the curb.

Referring now to FIGS. 16 and 117, arrow 7 refers generally to the spanner-type inventive cover support that can compensate at least in part for an inclination of the surrounding paving; the high side of the support is to the right side.

Figure 17:
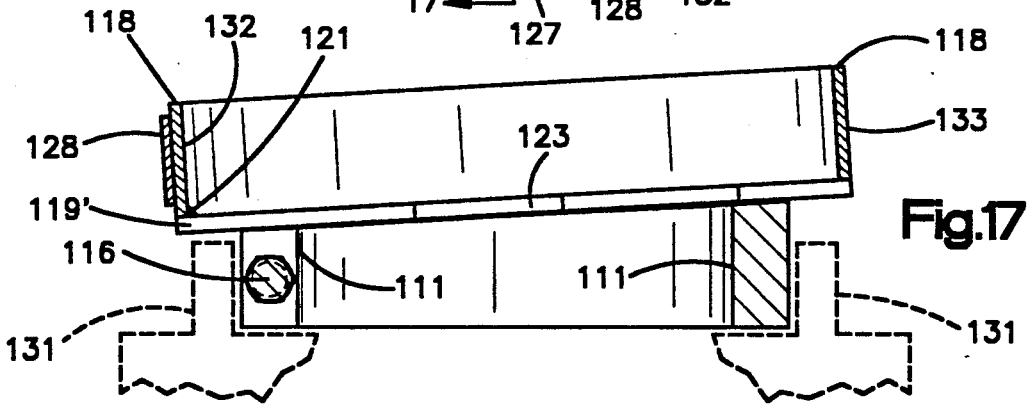
FIG. 17 is a cross sectional elevation of the apparatus of FIG. 16 taken through Section 17—17 thereof. It has an inclined plane across the upper surfaces of the spanners established by the slope of the top of the inner ring that supports the spanners.

The plan view, FIG. 16, is quite like that of the level manhole cover support shown in FIG. 1, except that some of the outside wall 133 of the keeper ring 118 and some of the inside wall 132 of the same keeper ring 118 are visible in FIG. 16 because of the tilt of the cover support 7. Accordingly, the item numbers of FIGS. 16 and 17 correspond to those for the same item in FIG. 1, except that they are one hundred higher. In other words, the keeper ring in FIG. 16 is 118 rather than 18 like FIG. 1, and so on.

Figure 18:
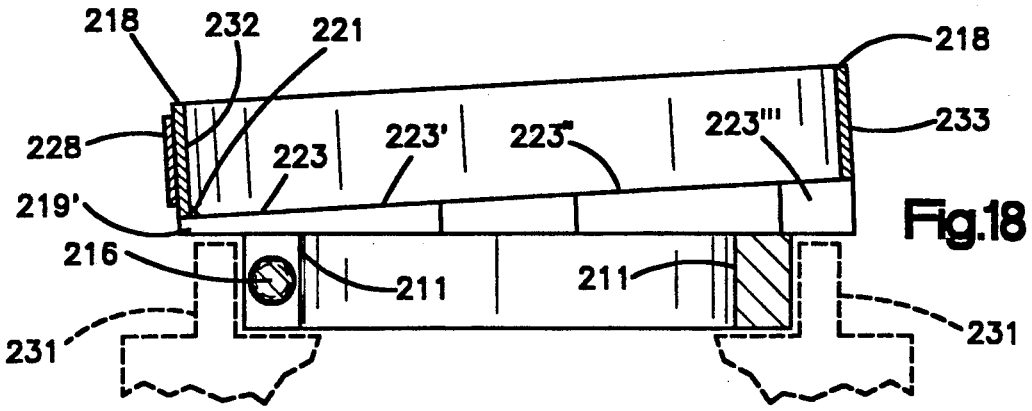
FIG. 18 is a cross sectional elevation of an apparatus having the same plan view as FIG. 16 and taken through the same cross section, but it has spanners of different thickness which establish the inclined plane across their upper surfaces on which to rest a manhole cover. In essence, the spanners are somewhat wedge-shaped.

As the plan view of the tilted cover support whose cross sectional elevation is FIG. 18 looks very much like FIG. 16, such plan view corresponding to the vertical cross section displayed in FIG. 18 is not shown. The profile, FIG. 18, is adequate to show the tilting of the device because of its having spanners that establish the inclined plan on which to rest the cover (rather than the incline of the top of base ring 111 as in FIG. 17). Thus, keeper ring 218 with inner wall 232 and outer wall 233 is held tilted by the tilted plane established by the tops of the spanners, i.e., spanners 223, 223', 223'', and 223'''; adjustment of base ring 211 is made within the confines of manhole frame 231 by adjusting nut 216 of the turnbuckle in base ring 211. The mud flap 228 protects the aperture in keeper ring 218. The item numbers correspond to those of FIG. 7 but are one hundred higher, e.g., adjustment nut 216 instead of 116.

Figure 19:
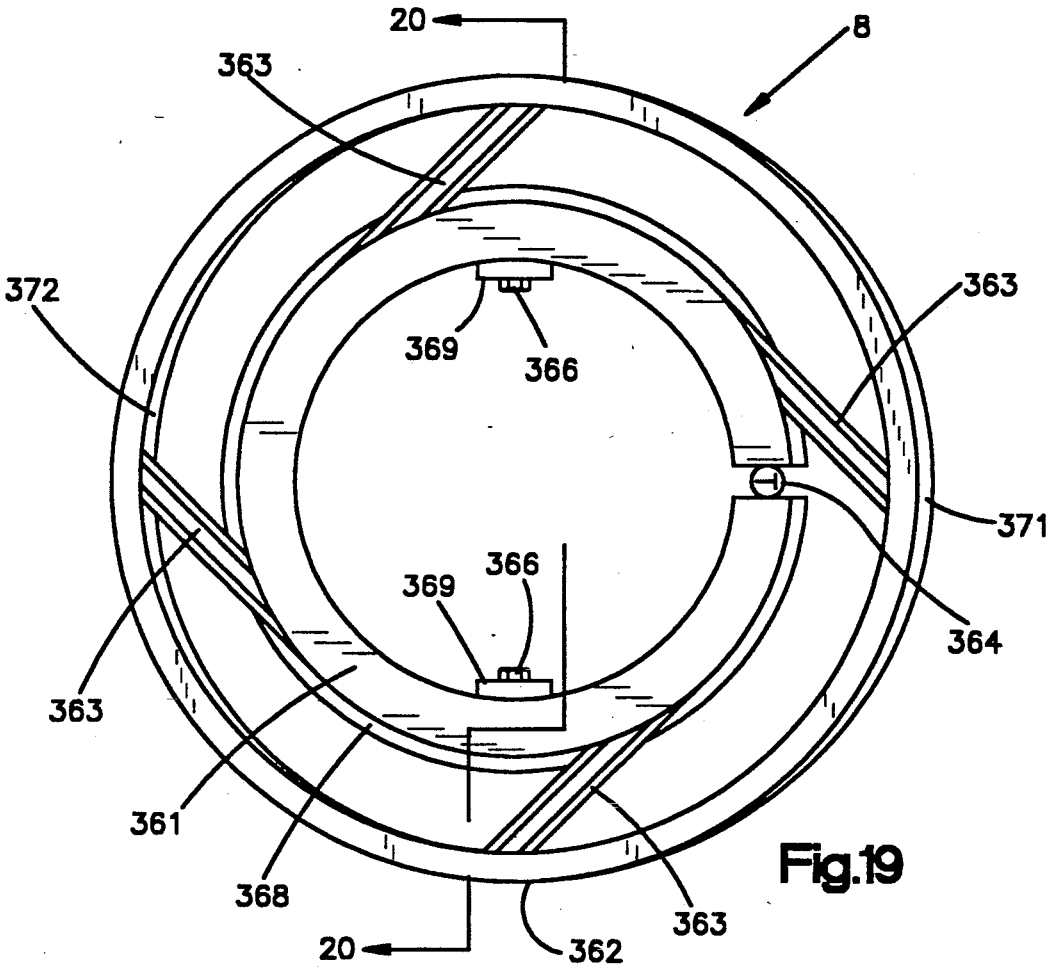
FIG. 19 is a plan view of another cover support made for the same purpose as the cover support shown in FIG. 16.
Figure 20:
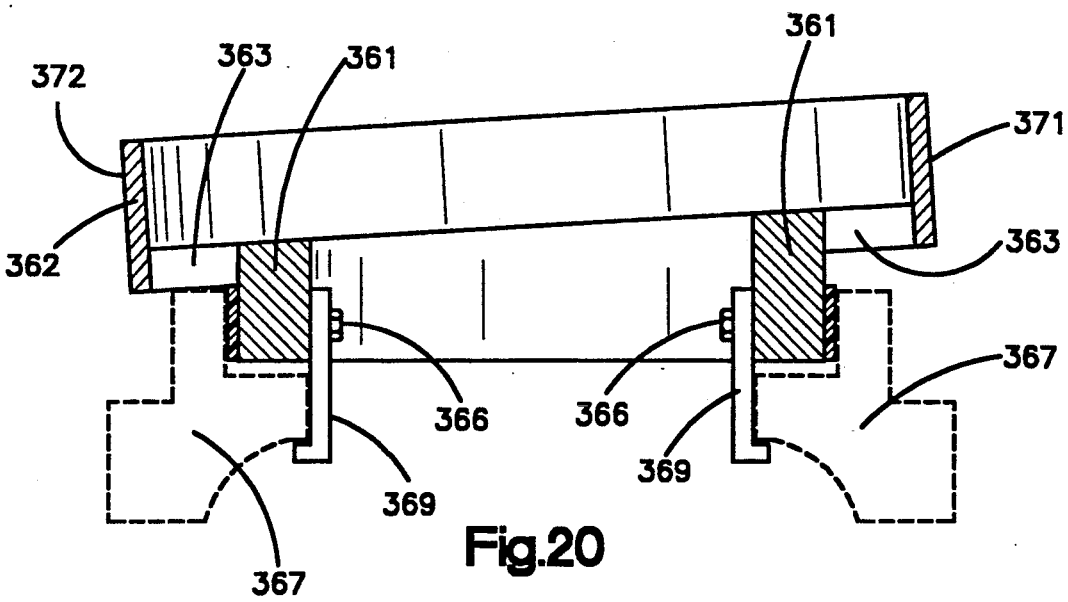
FIG. 20 is a vertical cross section of FIG. 19 taken through Section 20—20 thereof and having an inclined plane across the upper surfaces of both the spanners and the base ring to which such spanners are attached.

Reference now is made to FIGS. 19 and 20. Arrow 8 refers generally to another spanner-type cover support that can compensate at least in part for an inclination in the surrounding paving The plan view, FIG. 16, is quite like that of the level manhole cover support shown in FIG. 13, except that some of the outside wall 371 and inside wall 372 of the keeper ring 362 are visible in FIG. 19 because of the tilt of the cover support 8. Accordingly, the items numbered in FIGS. 19 and 20 correspond to those in FIGS. 13 and 14, except that they are three hundred higher.

While an expandable base ring has been shown with four segments and a split ring, it clearly can more or less segmented. In tests on broadly related manhole cover supports for use with a nominally 23-inch manhole, a split steel rig cover support had roughly double the grip in a steel retaining ring when coated with about an ⅛ uncoated to give steel-to-steel contact. Furthermore, the force needed to remove a broadly related four-segmented cover support of the same size from the same retaining ring was about 1.41 times that for the split ring one when both had the same kind of retention components on their outer walls and about the same retaining stress was exerted thereon.

While the cover supports of FIGS. 5 and 13 show keeper rings that are continuous, they also can be split, if desired. In such instances it is best to protect the gap in the ring with a covering flap.

The keeper ring and base ring preferably are substantially concentric, but the outside of the inner ring can be displaced towards the inside of the keeper ring to depart from concentricity if that is desired in particular instances. Ferrous metals are the preferred metals for the rings and frequently for the spanners because of their strength and price.

The preferred type of turnbuckle spreader for the base is shown in the drawings. Of course, the more conventional turnbuckls with a central female member receiving a threaded bolt from each side, the bolts being threaded oppositely to each other, can be used. Also useful is simply a threaded bolt working against an inwardly-projecting bracket-like reaction piece as the spreader device, the bolt being threaded through an inwardly projecting opposing bracket and pressing the reaction piece away therefrom, thus enlarging the outer periphery of the base. While the rings have been illustrated mostly as one-piece units, clearly they can be made of a plurality of joined sections, eg. bolted or welded together, if desired.

Modifications and variations of the invention will be apparent to those skilled in the art in the light of the foregoing detailed disclosure. Therefore, it is to be understood that, within the scope of the appended claims, the invention can be practiced otherwise than shown and described.

I claim:

1. A manhole cover support for raising the grade of an existing cover-receiving structure for a circular manhole, said receiving structure having a circular rim establishing a top outer periphery, the cover support comprising:

a base ring for fitting inside the existing manhole cover-receiving structure, said base ring having nominal outside diameter of $D_1$ and at least one adjustable joint for adjustment of the base ring periphery;

a lateral cover keeper ring rising from a level near the top of the base ring and extending above and around it, said keeper ring having nominal inside diameter of $D_2$ which is substantially larger than said diameter $D_1$ and an outer periphery that is at least substantially coextensive with the outer periphery of the top of the cover-receiving structure;

means for making an adjustment in the periphery of the base ring, and a plurality of spanners which bridge the distance between the rings, the inner terminal of each spanner making contact with the base ring at or near its top, the outer terminal of each spanner making contact with the keeper ring at or near its bottom, at least a pair of the spanners being connecting spanners having their inner terminals connected to the base ring and their outer terminals connected to the keeper ring to constitute a linkage between said rings, the spanners and/or the keeper ring being disposed to reposition themselves in the cover support structure in response to and in accommodation of an adjustment in the periphery of the base ring.

2. The manhold cover support of claim 1 wherein the periphery of the keeper ring is enlarged or diminished by the movement of stiff connecting spanners responding to an adjustment in the periphery of the base ring.

3. The manhole cover support of claim 1 wherein said inner terminal contacts and/or said outer terminal contacts resposition themselves in response to and in accommodation of an adjustment in the periphery of the base ring.

4. The manhole cover support of claim 1 wherein the spanners are swept back and change their angle of incidence with the inside of the keeper ring and the outside of the base ring in response to and in accommodation of an adjustment in the periphery of the base ring.

5. The manhole cover support of claim 1 wherein the existing manhold cover-receiving structure is one of a group of existing manhole cover-receiving structures whose existing cover openings are circular, but include cover openings that differ somewhat in diameter to the extent that they are incapable of having their manhold covers completely interchangeable amongst them, the cover support being suitable for using a single diameter of manhold cover to the entire group.

6. The manhole cover support of claim 1 wherein the rings comprise ferrous metal.

7. The manhole cover support of claim 1 wherein the keeper ring is of steel.

8. A manhold cover support for raising the grade of an existing cover-receiving structure for a circular manhold, the cover support comprising:

a metal base ring for fitting tightly inside the existing manhold cover-receiving structure, said base ring having nominal outside diameter of $D_1$ and at least one adjustable joint for adjustment of the base ring periphery;

a metal lateral cover keeper ring that rises from level that is near the top of the base ring and extends above and is substantially concentric with it, said keeper ring having nominal inside diameter of $D_2$ which is substantially larger than said diameter $D_1$, the keeper ring having at least one interruption in its periphery, each said interruption being generally opposite to a corresponding adjustable joint of the base ring, an interruption and its corresponding adjustable joint constituting an hiatus in the cover support;

screw means for making an adjustment in the periphery of the base ring, and a plurality of fixed-length spanners which bridge the distance between the rings, the inner terminal of each spanner making contact with the base ring at or near its top, the outer terminal of each spanner making contact with the keeper ring at or near its bottom, at least a pair of the spanners being connecting spanners having their inner terminals fixedly connected to the base ring and their outer terminals fixedly connected to the keeper ring to constitute a linkage between said rings, one of each of said pair of connecting spanners being on one side of a particular hiatus in the cover support, the other of a pair being on the other side of said particular hiatus, the linkage forcing an accommodating adjustment in the periphery of the keeper ring in response to an adjustment in the periphery of the base ring.

9. The manhold cover support of claim 8 wherein an outer terminal of each pair of connecting spanners is in the vicinity of one side of a particular interruption in the keeper ring, the corresponding other outer terminal of said pair is in the vicinity of the other side of said particular interruption, an inner terminal of each pair of connecting spanners is in the vicinity of and on one side of an adjustable joint in the base ring that corresponds to said particular interruption, and the corresponding other inner terminal of said pair of connecting spanners is in the vicinity of the other side of said particular adjustable joint.

10. The manhole cover support of claim 8 wherein the rings comprise ferrous metal.

11. The manhole cover support of claim 10 wherein the ferrous metal of the keeper ring is steel, and the screw means is a turn-buckle bolt at the adjustable joint.

12. The manhole cover of claim 8 wherein the existing manhole cover-receiving structure is one of a group of existing manhole cover-receiving structures whose existing cover openings are circular, but include cover openings that differ somewhat in diameter to the extent that they are incapable of havir.g their manhold covers completely interchangeable amongst them, the cover support being suitable for using a single diameter of manhold cover for the entire group.

13. A manhole cover support for raising the grade of an existing cover-receiving structure for a circular manhold, the cover support comprising:

a ferrous metal base ring for fitting tightly inside the existing manhold cover-receiving structure, said base ring having nominal outside diameter of $D_1$ and an adjustable joint for adjustment of the base ring periphery;

a ferrous metal lateral cover keeper ring that rises from a level near the top of the base ring and extends above and is substantially concentric with, said keeper ring having a nominal inside diameter of $D_2$ which is substantially larger than the diameter $D_1$, the keeper ring having one interruption in its periphery, said interruption being generally opposite to the adjustable joint of the base ring, said interruption and joint constituting the hiatus in the cover support;

screw means for making an adjustment in the periphery of the base ring, and at least four fixed-length ferrous metal spanners which bridge the distance between the rings, the inner terminal of each spanner making contact with the base ring at or near its top, the outer terminal of each spanner making contact with the keeper ring at or near its bottom, a pair of said spanners being connecting spanners having their inner terminals fixedly connected to the base ring and their outer terminals fixedly connected to the keeper ring to constitute a linkage between said rings, the other spanners being sliding spanners that have their outer terminals fixedly connected to the keeper ring and their inner terminals in a slidable, substantially horizontal contact with the base ring, one of the pair of connecting spanners being on one side of the hiatus in the cover support the other of the pair being on the other side of said hiatus, the linkage forcing the widening or narrowing of the interruption in the keeper ring in response to a like adjustment in the adjustable joint of, and thereby the periphery of, the base ring.

14. A manhole cover support for raising the grade of an existing cover-receiving structure for a circular manhole, the cover support comprising:

a metal base ring for fitting inside the existing manhole cover-receiving structure, said base ring having nominal outside diameter of $D_1$ and at least one adjustable joint for adjustment of the base ring periphery;

a metal lateral cover keeper ring that rises from a level that is near the top of the base ring and extends above and is substantially concentric with, said keeper ring having nominal inside diameter of $D_2$ which is substantially larger than said diameter $D_1$;

means for making an adjustment in the periphery of the base ring, and a plurality of fixed-length spanners which bridge the distance between the rings, the inner terminal of each spanner making contact with the base ring at or near its top, the outer terminal of each spanner making contact with the keeper ring at or near its bottom, at least a pair of the spanners being connecting spanners having their inner terminals connected to the base ring and their outer terminals connected to the keeper ring to constitute a linkage between said rings, said terminal contacts repositioning themselves in response to and in accommodation of an adjustment in the periphery of the base ring.

15. The manhole cover support of claim 14 wherein the rings comprise ferrous metal.

16. The manhole cover support of claim 14 wherein the inner terminals of at least three connecting spanners have pivotal connections to the base ring and their outer terminals pivotally connected to the keeper ring to constitute the linkage between said rings.

17. The manhole cover support of claim 16 wherein the pivotal connections include a slot allowing translation of the pivot point.

18. The manhole cover support of claim 14 wherein said inner terminals make substantially horizontal contact with the base ring in slots in that ring.

19. The manhole cover support of claim 14 wherein said outer terminals make substantially horizontal contact with the keeper ring in slots in that ring.

20. The manhole cover support of claim 14 wherein the ferrous metal of the keeper ring is steel, the screw means is a turnbuckle bolt at each adjustable joint, and the existing manhole cover-receiving structure is one of a group of existing manhole cover-receiving structures whose existing cover openings are circular, but include cover openings that differ somewhat in diameter to the extent that they are incapable of having their manhole covers completely interchangeable amongst them, the cover support being suitable for using a single diameter of manhole cover for the entire group.

21. The manhole cover support of claim 14 wherein the inner terminal of each spanner has a substantially trapezoidal cross section with its bottom down, each said inner terminal fits slidably into a corresponding slot in the base ring, said base ring slot having a substantially trapezoidal cross section that restricts the inner terminal of the spanner from being lifted directly out of its slot, the outer terminal of each spanner has a substantially trapezoidal cross section with its bottom up, and each said outer terminal fits slidably into a corresponding slot in the keeper ring, said keeper ring slot having a substantially trapezoidal cross section that restricts the outer terminal of the spanner from being pulled directly downward and out of its slot.

22. The manhold cover support of claim 14 wherein the keeper ring is continuous.

23. A manhold cover support for raising the grade of an existing cover-receiving structure for a circular manhole, the cover support comprising:

a metal base ring for fitting inside the existing manhold cover-receiving structure, said base ring nominal outside diameter of $D_1$ and at least one adjustable joint for adjustment of the base ring periphery;

a metal lateral cover keeper ring that rises from a level that is near the top of the base ring and extends above and is substantially concentric with it, said keeper ring having nominal inside diameter of $D_2$ which is substantially larger than said diameter $D_1$;

means for making an adjustment in the periphery of the base ring, and a plurality of fixed-length, swept-back spanners which bridge the distance between the rings and make angle of incidence with the inside of the keeper ring and the outside of the base ring, the inner terminal of each spanner making contact with the base ring at or near its top, the outer terminal of each spanner making contact with the keeper ring at or near its bottom, at least a pair of the spanners being connecting spanners having their inner terminals connected to the base ring and their outer terminals connected to the keeper ring to constitute a linkage between said rings, the spanners changing said angle of incidence in response to and in accommodation of an adjustment in the periphery of the base ring.

24. The manhole cover support of claim 23 wherein the spanners are substantially straight in plan view.

25. The manhole cover support of claim 23 wherein the spanners are arcuate in plan view.

26. The manhole cover support of claim 23 wherein the rings comprise ferrous metal.

27. The manhole cover support of claim 23 wherein the spanners are flexible.

28. The manhole cover support of claim 23 wherein the spanners comprise a polymer composition.

29. The manhole cover support of claim 28 wherein the spanners comprise fabric-reinforced polymer composition.

30. The manhole cover support of claim 27 wherein the inner terminals of at least most of the spanners are fixedly attached to the base ring and the outer terminals of at least most of the spanners are fixedly attached to the keeper ring.

31. The manhole cover support of claim 23 wherein the keeper ring is continuous.

32. The manhole cover support of claim 23 wherein the existing manhole cover-receiving structure is one of a group of existing manhole cover-receiving structures whose existing cover openings are circular, but include cover openings that differ somewhat in diameter to the extent that they are incapable of having their manhole covers completely interchangeable amongst them, the cover support being suitable for use in a single diameter of manhole cover for the entire group.

33. The manhole cover support of claims 1, 8, 13, 14 or 23, wherein the base ring includes means for anchoring it to the existing cover-receiving structure.

34. The manhole cover support of claim 1 wherein the inclination of the surface that is to surround the emplaced cover support is at least partially compensated for by the spanners' upper surfaces being disposed for establishing a stable inclined plane on which to rest a manhole cover, the slope of said plane approaching that of said inclination.

35. The manhole cover support of claim 34 wherein the upper surface of the base ring lies below the inner terminals of the spanners, it is inclined and it supports said inner terminals.

36. The manhole cover support of claim 34 wherein the inner surface of the base ring lies below the inner terminals of the spanners, it is substantially horizontal, it supports said inner terminals, and the thickness of the spanners themselves establishes said inclined plane.

37. The manhole cover support of claim 1 wherein the inclination of the surface that is to surround the emplaced cover support is at least partially compensated by the upper surfaces of the spanners and the base ring being disposed for establishing a stable inclined plane on which to rest a manhole cover, the slope of said plane approaching that of said inclination.

* * * * *